US006427809B2

(12) United States Patent
Bammert

(10) Patent No.: US 6,427,809 B2
(45) Date of Patent: Aug. 6, 2002

(54) AUXILIARY DEVICE FOR DISPLACING A PAYLOAD RECEPTACLE OF AN ELEVATOR AND DEVICE FOR MONITORING THE POSITION AND THE MOVEMENT OF A CAGE IN A SHAFT OF AN ELEVATOR

(75) Inventor: Kurt Bammert, Lucerne (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/824,311

(22) Filed: Apr. 2, 2001

(30) Foreign Application Priority Data

Mar. 31, 2000 (EP) ..... 00810283

(51) Int. Cl.[7] ..... B66B 3/00
(52) U.S. Cl. ..... 187/391; 187/263
(58) Field of Search ..... 187/391–394, 187/277, 414, 250, 263

(56) References Cited

U.S. PATENT DOCUMENTS

| | | | | |
|---|---|---|---|---|
| 4,007,811 A | * | 2/1977 | Ozawa | 187/29 R |
| 4,096,925 A | * | 6/1978 | Koob et al. | 187/29 R |
| 4,322,712 A | | 3/1982 | Yoshida | |
| 4,735,295 A | * | 4/1988 | Hochstrasser et al. | 187/134 |
| 5,971,109 A | | 10/1999 | Aulanko et al. | |
| 6,269,910 B1 | * | 8/2001 | Fargo et al. | 187/287 |
| 6,302,240 B1 | * | 10/2001 | Shih | 187/414 |
| 6,336,523 B1 | * | 1/2002 | Ozeki et al. | 187/391 |

FOREIGN PATENT DOCUMENTS

| | | | |
|---|---|---|---|
| DE | 42 19 073 A1 | | 12/1993 |
| DE | 296 15 921 U1 | | 4/1997 |
| DE | 298 17 351 U1 | | 11/1999 |
| EP | 508 403 A2 | | 10/1992 |
| EP | 947 460 A1 | | 10/1999 |
| FR | 2 600 053 | | 12/1987 |
| JP | 3-98970 A | * | 4/1991 |
| JP | 6-219663 | * | 6/1994 |
| JP | 092 78 328 | | 10/1997 |

* cited by examiner

*Primary Examiner*—Jonathan Salata
(74) *Attorney, Agent, or Firm*—Cohen, Pontani, Lieberman & Pavane

(57) ABSTRACT

The auxiliary device is needed when the elevator stands in the elevator shaft outside a station. The auxiliary device includes an auxiliary drive device for the payload receptacle. For sight-free observation of the auxiliary device there is arranged an image transmission device, which includes a sensor, a display device and a transfer path. The sensor serves for detection of images which illustrate a drive pulley coupled with the auxiliary drive device. The display device serves for visualization of the images detected by the sensor, and the transfer path serves for transmission of the images detected by the sensor to the display device.

17 Claims, 6 Drawing Sheets

AUXILIARY DEVICE FOR DISPLACING A PAYLOAD RECEPTACLE OF AN ELEVATOR AND DEVICE FOR MONITORING THE POSITION AND THE MOVEMENT OF A CAGE IN A SHAFT OF AN ELEVATOR

BACKGROUND OF THE INVENTION

1. Field of the Invention

The invention relates to an auxiliary device for displacing a payload receptacle of an elevator and to a device for monitoring the position and the movement of a cage in a shaft of an elevator.

2. Description of the Related Art

Elevators with an auxiliary device of that kind are usually used for the transport of persons or goods in a vertical direction between at least two vertically offset stations and are arranged in an elevator shaft in or at a building. The wall bounding the elevator shaft has at the level of each station a loading/unloading opening which is closable by means of a door device and at which a waiting zone adjoins, in which the payloads are disposed before loading or after unloading of the payload receptacle. Such an elevator essentially comprises a payload receptacle such as a platform or a cage, a counterweight for the payload receptacle, a drive device, a braking device, at least one flexible support and drive element, such as for example a cable or rope, and the necessary electronic power and control system. The flexible support and drive element connects the payload receptacle with its counterweight and runs between the payload receptacle and counterweight by way of a drive wheel of the drive device. The drive device is disposed in the transport shaft above the zone thereof usable by the payload receptacle. If braking takes place in consequence of a technical problem, thus an emergency braking, the load receptacle is usually not disposed in a station. The auxiliary device then has to be actuated in order to bring the load receptacle to a station in the shortest time, so that the persons and/or goods being transported do not have to remain in or on the load receptacle in the transport shaft. The auxiliary device comprises on the one hand a temporarily activatable brake release device, by which the braking device is released, and on the other hand an auxiliary drive device actuable in the case of emergency in order to raise or lower the load receptacle when the release device is activated; in that case, the load receptacle has to be brought into one of the stations or at least in to a region in the vicinity of a station where a risk-free unloading can take place. The auxiliary drive device is generally constructed so that it allows manual actuation of the drive pulley, which in normal operation is actuated by motor, of the drive device; consequently, this drive pulley can also be considered as part of the auxiliary drive device. For elevators which are mounted in buildings with few storeys and are designed for transport of relatively small payloads, simple, manually actuable and mechanically operating brake release and auxiliary drive devices are preferably provided.

EP 0 947 460 A1 describes such an auxiliary device for an elevator for persons, with a release device and an auxiliary drive device. This possesses a crank rod linkage, which is so constructed that it is used not only for activating a brake release device, but also for the drive of an auxiliary drive device. The upper end region of the crank rod linkage can be coupled with the brake release element and with the element of the auxiliary drive and is disposed in the uppermost part of the transport shaft. The crank rod linkage is constructed to be pivotable and mounted in such a manner that it can be pivoted from a rest position in which it is disposed entirely in the elevator shaft into an operative position in which its lower end region projects through a window opening of a wall bounding the elevator shaft. The window opening lies in the upper region of the uppermost station, so that the crank rod linkage can be readily actuated at its lower end by way of appropriate handle elements by a person standing in the waiting zone of the station. The disadvantage of this device is to be seen in that the actuation thereof has to take place at the level of the uppermost station; this disadvantage is of particular significance when this station is disposed within a residential unit, as is frequently the case in superior dwellings and particularly in maisonette dwellings and penthouse dwellings.

There is known from DE GM 296 15 921 U1 an auxiliary device which is improved with respect thereto and in which the operation of the device can take place from a location disposed at a certain distance from the uppermost station of the elevator. However, this auxiliary device is of comparatively complicated construction. A substantial disadvantage of such auxiliary devices resides in the fact that it is not possible for a person who is actuating it to observe the movement, which is taking place in the uppermost region of the elevator shaft, of the auxiliary drive device as generally no direct visual link exists between this uppermost region of the elevator shaft and the person carrying out the operation. Certainly with a suitable arrangement of an observation window the flexible support and drive element at which the load receptacle is suspended can be observed without further measures from a location outside the elevator shaft and thus an indication obtained about the movement of the payload receptacle, but in many cases this is considered to be an inadequate solution. In order to actually observe an element of the auxiliary drive device such as the drive pulley the person carrying out the operation is obliged to move at least his or her head and neck region into the elevator shaft, which forms a source of risk for this person and can hinder them during actuation of the auxiliary device.

Moreover, the view of the uppermost region of the elevator shaft through the payload receptacle is obstructed if this is disposed above the location of the person carrying out the operation.

SUMMARY OF THE INVENTION

It is therefore an object of the present invention to provide an auxiliary device for displacing a payload receptacle of an elevator and a device for monitoring the position and the movement of a cage in a shaft of an elevator which are simple with respect to construction, arrangement and operation and which can be operated from a storey lying at one or more levels below the uppermost storey.

The auxiliary device according to the invention comprises an image transmission device which essentially consists of a sensor, a display device and a transfer path. The sensor serves the purpose of detecting at least one image of the movement of the auxiliary drive. The display device serves the purpose of making visible the images, which are picked up by the sensor, for the attention of the person carrying out the operation. The transfer path serves for transmission to the display device of the images detected by the sensor. In the case of arrangement of the operating elements of the auxiliary device far below the uppermost floor, thanks to an image transmission device of that kind the display device can be mounted in the immediate vicinity of the operating elements of the brake release and auxiliary drive device.

In the case of the device according to the invention for monitoring the position and the movement of a cage in a shaft of an elevator there is provided a first means for monitoring the movement of the cage, which comprises a unit for detection of the movement, an information transmission path and a display unit. In addition, there is provided a second means for monitoring the position of the cage, which comprises a means for reproducing the position of the cage.

In a first embodiment of the auxiliary device the image transmission device thereof is formed by at least two mirrors. The first mirror serves as a sensor and is oriented towards the auxiliary drive; the second mirror serves as a display device and is oriented towards an observation window, which is arranged in the wall of the elevator shaft at the location provided for the person carrying out the operation. The transfer path is formed by the optical coupling region between the first and the second mirror. This arrangement is comparatively simple in construction and reliable in operation. Moreover, it allows visualization on the display device not only of an image of the movement of the auxiliary drive, but also of the constructional elements of the auxiliary drive itself and the surroundings thereof. However, attention must be given to mounting the mirror so that the payload receptacle does not reach into the transfer path and thereby interrupt it. Moreover, measures must be undertaken in order to sufficiently brighten the elevator shaft, including when the auxiliary device has to be set in motion due to a mains failure. The image transmission device can also comprise one or more additional mirrors arranged along the transfer path between the first and the second mirror. In that case, each mirror is oriented towards the two mirrors adjacent thereto in the transfer path. The additional mirrors in such an arrangement can be considered to be components of the transfer path. In order to obtain good image quality, it can be advantageous if individual mirrors have reflection surfaces which are not planar, but concave or convex.

Apart from the purely optical image transmission device with mirrors, there can also be provided an image transmission device in which the transfer path is formed by a continuous conductor connection. This gives rise to, inter alia, the following advantages; the transfer path can be extended as desired; there is no risk that the transfer path is interrupted by the payload receptacle; the display device can be mounted at a location which is optimum for the person carrying out the operation; and it is not necessary to provide an actual observation window in the wall of the elevator shaft, because a small passage in this wall suffices for passing through the conductor connection. By contrast to the image transmission device with mirrors, it is further not necessary to provide emergency lighting for the entire transfer path, as merely sufficient light has to be present to guarantee the function of the sensor.

In the case of an auxiliary device of which the image transmission device functions in optimum manner, the sensor is formed by a video camera and the display device by a monitor, wherein the conductor connection is formed by an electrical conductor connection connecting the video camera with the display device. As in the case of the image transfer device with mirrors, there appears on the display device, i.e. on the monitor, an image of the auxiliary drive device and also its immediate environment. It is thereby possible to obtain more accurate indications of malfunctions. Several video cameras can also be mounted at different places within the elevator shaft, wherein the images detected by them can be alternatively and selectably visualised on the monitor.

Auxiliary devices with an image transmission device of which the transfer path is formed by a conductor connection can also be conceived in such a manner that they comprise a rotary element which rotates fixedly with the shaft of the auxiliary drive device and the rotation of which is detected by the sensor. In that case there appears on the display device not an image of the auxiliary drive itself, but an image of the movement of the auxiliary drive.

A conventional tachometer device can be mounted, as the sensor, at the shaft of such a rotary element which is preferably identical with the shaft of the auxiliary drive. The conductor arrangement in this case is an electrical conductor arrangement. The display device, namely a conventional tacho display, can reproduce the image not only of a movement of the auxiliary drive device, but also of the speed thereof.

In another construction of the image transfer device with a conductor connection between the sensor and display device, the rotary element is constructed as a rotary disc and has light-permeable zones which are arranged at mutual angular spacings and generally at a constant radial spacing from the rotational axis of the rotary element. As a rotary element or rotary disc there is preferably used a drive pulley of the drive of the elevator, over which the flexible support and actuating elements for the payload receptacle run. Such a drive pulley constantly rotates during displacement of the payload receptacle. Arranged on one side of the rotary disc is a light source which is so oriented that the light beam emitted by it is incident on a sector of the radial region of the rotary disc in which the light-permeable zones of the rotary disc are disposed. The sensor is arranged on the opposite side of the rotary disc. The display device shows an image of the movement of the drive or of the auxiliary drive or of the rotary disc. The display device is, for example, a monitoring light which blinks at the rhythm in which the light-permeable zones rotate away below the beam emitted by the light source, so that a bright/dark alternation is visible. The spacing in terms of time of the bright/dark alternation is a measure of the speed of the auxiliary drive and thus also of the payload receptacle.

In an image transmission device of that kind the light source can be formed by a first element of a light barrier and the sensor by the complementary second element of the light barrier. The conductor connection is, in that case an electrical conductor connection.

In an image transmission device which is similar to that just described the sensor is formed by an input of an optical conductor arrangement. The optical conductor arrangement itself is the conductor connection or the transfer path. The output of the optical conductor connection is oriented towards the display device, which acts in the manner of a monitoring light. As in the case of the image transmission device with a tachometer or light barrier there is in this case transmitted not an image of the drive pulley itself, but merely an image of the movement of the drive pulley. However, it is possible with a modification of this arrangement to transmit an image of the drive pulley itself; for this purpose several optical conductors, for example $n^2$ optical conductors must be used. The inputs and outputs of the conductors are respectively arranged in n columns to n lines. The larger the number n of optical conductors, the finer the scanning-pattern image that is received of the drive pulley.

The initially described construction of the image transmission device with mirrors has, as already mentioned, a non-material transfer path. This would be particularly advantageous in cases in which an existing elevator has to be subsequently equipped with an image transmission device. However, this is usually not possible with mirrors which need for that purpose a free space for the beam path near the load receptacle. Thereagainst, a comparatively simple and space-saving image transmission device can be realized if a non-material transfer path in the form of a radio or laser connection is used.

The new auxiliary device comprises, in accordance with the invention, an image transmission device which, as explained, can be constructed in very diverse ways. It is also possible to provide image transmission devices which consist of several serially arranged part devices constructed and operable in accordance with several of the above-described principles.

Advantageously, in the case of the device according to another embodiment of the invention, a drive unit for movement of the cage is provided. The unit for detection of the movement of the cage enables a conclusion about the movement of the cage to be made by way of the detection of the movement of a movable part of the drive unit.

Moreover, a speed-limiting unit can be provided, wherein the unit for detection of the movement of the cage enables a conclusion about the movement of the cage to be made by way of the detection of the movement of a movable part of the speed-limiting unit.

The unit for detection of the movement of the cage can advantageously comprise a flexible shaft which is connected with the movable part of the drive unit. The display unit comprises a rotating disc or a tachometer.

The unit for detection of the movement of the cage comprises, in a further embodiment of the invention, a flexible shaft which is connected with the movable part of the speed-limiting unit. The display unit comprises a rotating disc or a tachometer.

In one embodiment of the invention the speed-limiting unit comprises a cable, wherein the means for reproducing the position of the cage comprises marks at the cable of the speed-limiting unit.

Moreover, a support means, which is connected with the cage, can be provided, wherein the means for producing the position of the cage comprises marks at the support means.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
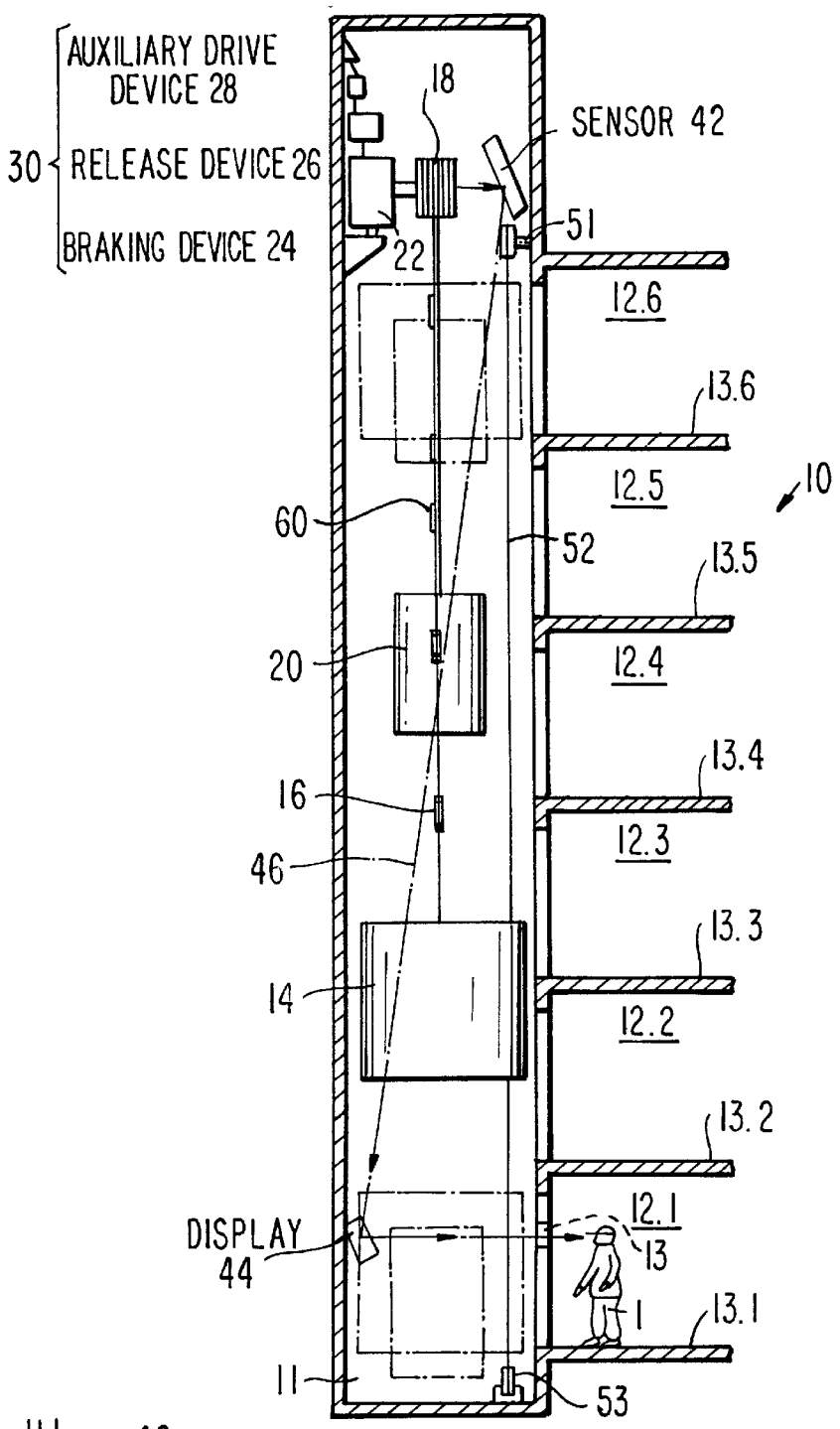
FIG. 1A shows a first auxiliary device according to the invention, with an image transmission device with mirrors, from the side.

FIG. 1A shows an elevator 10 with an elevator shaft 11, which serves several stations—denoted in the following as stopping points or storeys—12.1, 12.2, 12.3, 12.4, 12.5 and 12.6 in floors arranged one above the other, wherein the station 12.1 is disposed in the basement and the station 12.6 at the uppermost floor. At each station, a door opening, which is closable by means of a not-illustrated door, is present in the wall of the elevator shaft 11 and gives access to a payload receptacle (=elevator cage) 14 when this is at rest in the station. The payload receptacle 14 is constructed as a cage and is vertically movable within the elevator shaft 11. It is fastened at one end of a flexible support and drive element 16. Starting from the payload receptacle 14 the flexible support and drive element 16 runs upwards to a drive pulley 18 in the uppermost region of the elevator shaft 11, runs around this drive pulley 18 and runs back down to a counterweight 20 of the payload receptacle 14. A drive device 22 serves for driving the drive pulley 18. In the following the drive pulley 18 in conjunction with the drive device 22 is also termed drive unit. Disposed in the uppermost region of the elevator shaft 11 are, moreover, a braking device 24, a temporarily activatable brake release device 26 and an auxiliary drive device 28 for the drive pulley 18. The brake release device 26 and the auxiliary drive device 28 are components of an auxiliary device 30, which serves the purpose of moving the payload receptacle 14 when, due to technical problems, it is blocked by the braking device 24 between two adjacent ones of the stations 12.1 to 12.4.

A speed limiter 51 is provided in the upper region of the elevator shaft 11 for speed monitoring. A limiter cable 52 is guided from the speed limiter 51 over a deflecting roller 53 mounted in the shaft pit and back to the speed limiter 51. The limiter cable 52 is mechanically connected with the elevator cage 14. If the speed of the elevator cage 14 rises above a defined upper speed nominal value, the speed limiter 51 triggers a braking device, which is not shown in FIG. 1 and which brakes the elevator cage 14 safely to a halt and retains it in this position.

A waiting area is disposed in front of the elevator cage 14 at each floor; the pedestrian floor surfaces of the waiting areas are denoted by 13.1 to 13.6. For displacement of the payload receptacle 14, which according to FIG. 1 is blocked between the stations 12.2 and 12.3, to the station 12.2 the brake release device 26 is activated in not-illustrated manner by an operative 1 who is located at the level of the station 12.1, in the present case in the waiting area thereof, and who actuates the auxiliary drive device 28 during the activation of the brake release device 26. The drive pulley 18 rotates under the action of the auxiliary drive 28, whereby the flexible support and drive element 16 is set into motion with the consequence that the payload receptacle 14 is, in accordance with the respective rotational direction of the drive pulley 18, raised, or as envisaged here, lowered. The auxiliary device 30 according to the invention moreover comprises an image transmission device 40, with the assistance of which it is possible for the operative 1 to observe the movement of the drive pulley 18 from his or her location outside the elevator shaft 11 and without a direct visual link to the drive pulley 18. An arrangement of the operating elements of the auxiliary device 30 as well as the display device of the image transmission device 40 in the lowermost floor, thus in the basement, can be worthy of recommendation, since a separate monitoring and operating space can optionally be bounded off there so that, for example, an actuating device and other devices of the auxiliary device 30 can be accommodated in vandal-proof manner, but it is obviously also possible to select a higher floor for that purpose.

The image transmission device 40 essentially consists of a sensor 42, a display device 44 and a transfer path 46, which connects the sensor 42 with the display device 44. The previously described parts are, in principle, the same in all described embodiments. The various auxiliary devices 30 differ in practice only by the different construction of their image transmission devices 40.

Figure 1B:
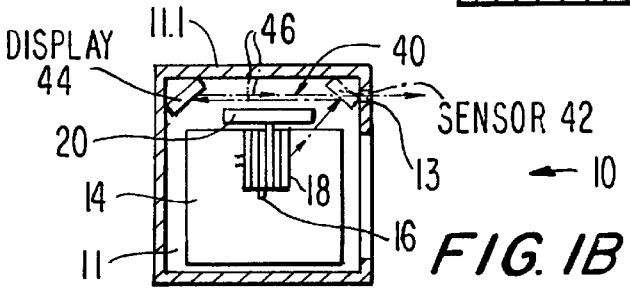
FIG. 1B shows the auxiliary device illustrated in FIG. 1A, from above.

The embodiment illustrated in FIGS. 1A and 1B shows an image transmission device with mirrors. The sensor 42 is formed by a first mirror similarly denoted by 42. This first mirror is oriented not only towards the drive pulley 18, but also towards the display device 44, which is formed by a second mirror similarly denoted by 44. The second mirror 44 is oriented towards the first mirror 42 and, moreover, is so arranged that it is viewable from the lowermost station 12.1 by way of a window opening 13 of the wall of the elevator shaft 11. The first mirror 42 thus reflects the image of the drive pulley 18 and projects it onto the second mirror 44; the second mirror 44 reflects the image of the drive pulley 18 in direction towards the window opening 13. FIG. 1B shows that a free space 11.1 for the transfer path 46, which here is formed merely by the beam path, is present in the elevator shaft 11 laterally near the payload receptacle 14 and the counterweight 20. In the following the speed limiter 51, the limiter cable 52 and the deflecting roller 53 are termed a unit for speed limitation.

The image transmission device 40 can also be so arranged that it reproduces one or more of the movable parts of the unit 51, 52, 53 for speed limitation.

Figure 2A:
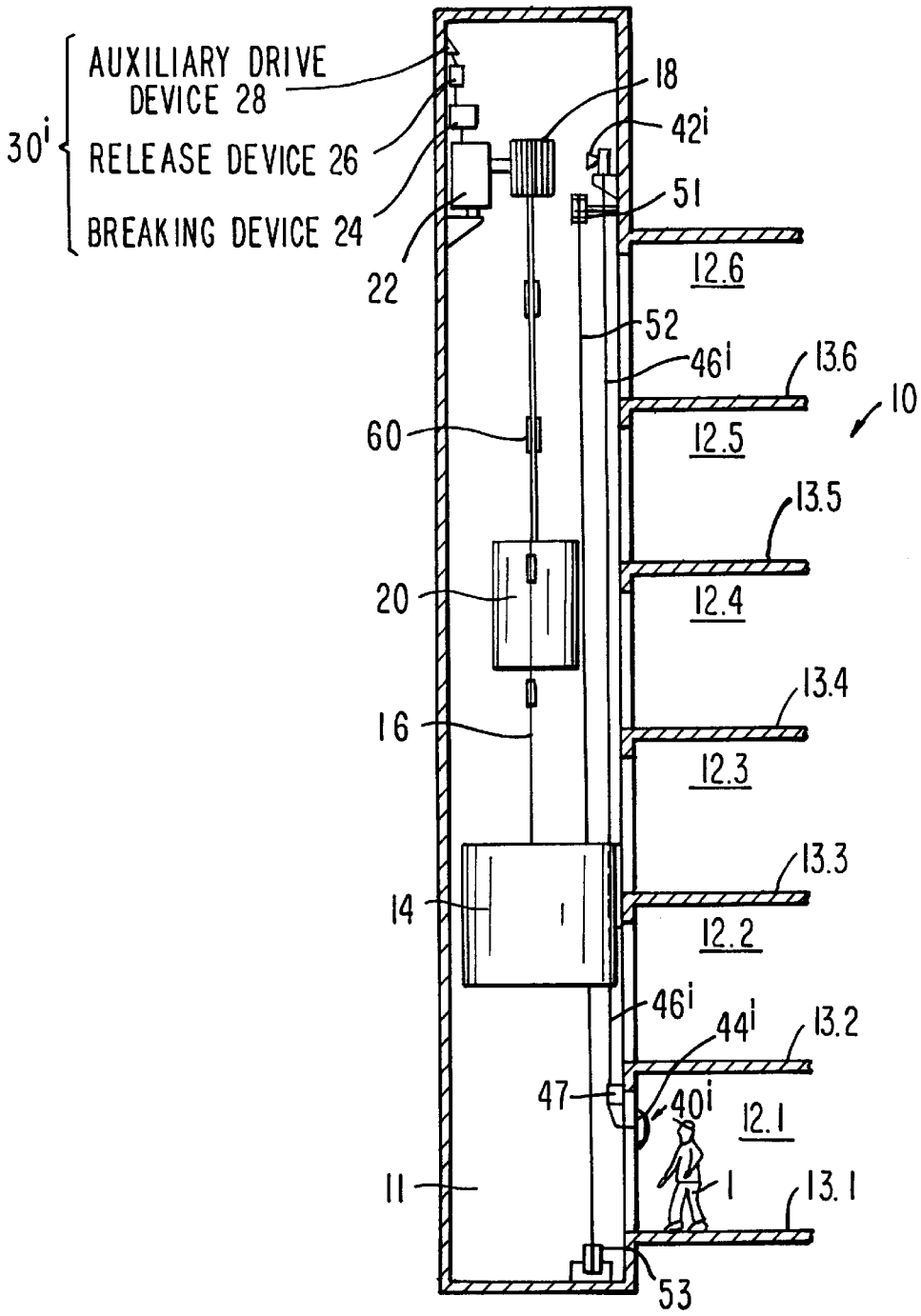
FIG. 2A shows a second auxiliary device according to the invention, with an image transmission device with a video system, in the same representation as FIG. 1A.
Figure 2B:
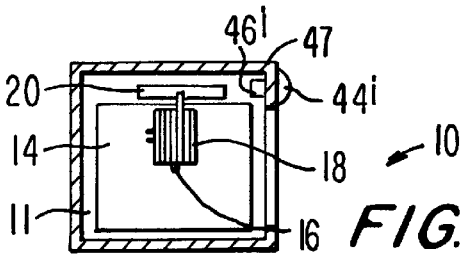
FIG. 2B shows the auxiliary device illustrated in FIG. 2A, in the same representation as FIG. 1B.

FIGS. 2A and 2B show a second auxiliary device $\mathbf{30}^{i}$ for an elevator 10, which differs from the elevator illustrated in FIGS. 1A and 1B by a differently designed image transmission device $\mathbf{40}^{i}$ and—in connection therewith—by the absence of the free space 11.1, which is not necessary here, in the elevator shaft 11; such a free space 11.1 is also redundant in all further described embodiments. The image transmission device $\mathbf{40}^{i}$ is here formed by a video system, with a video camera $\mathbf{42}^{i}$ as the sensor, a monitor $\mathbf{44}^{i}$ as the display device and an electric conductor connection 46 as the transfer path between the video camera $\mathbf{42}^{i}$ and the monitor $\mathbf{44}^{i}$. The video camera $\mathbf{42}^{i}$ is disposed in the uppermost region of the elevator shaft 11 and is so arranged that it picks up images of the drive pulley 18. The monitor $\mathbf{44}^{i}$ is disposed in the lowermost station 12.1; it can be arranged behind a door for protection against destruction. An emergency current unit 47 for the video system is arranged in the elevator shaft 11 in the region of the station 12.1.

Figure 3:
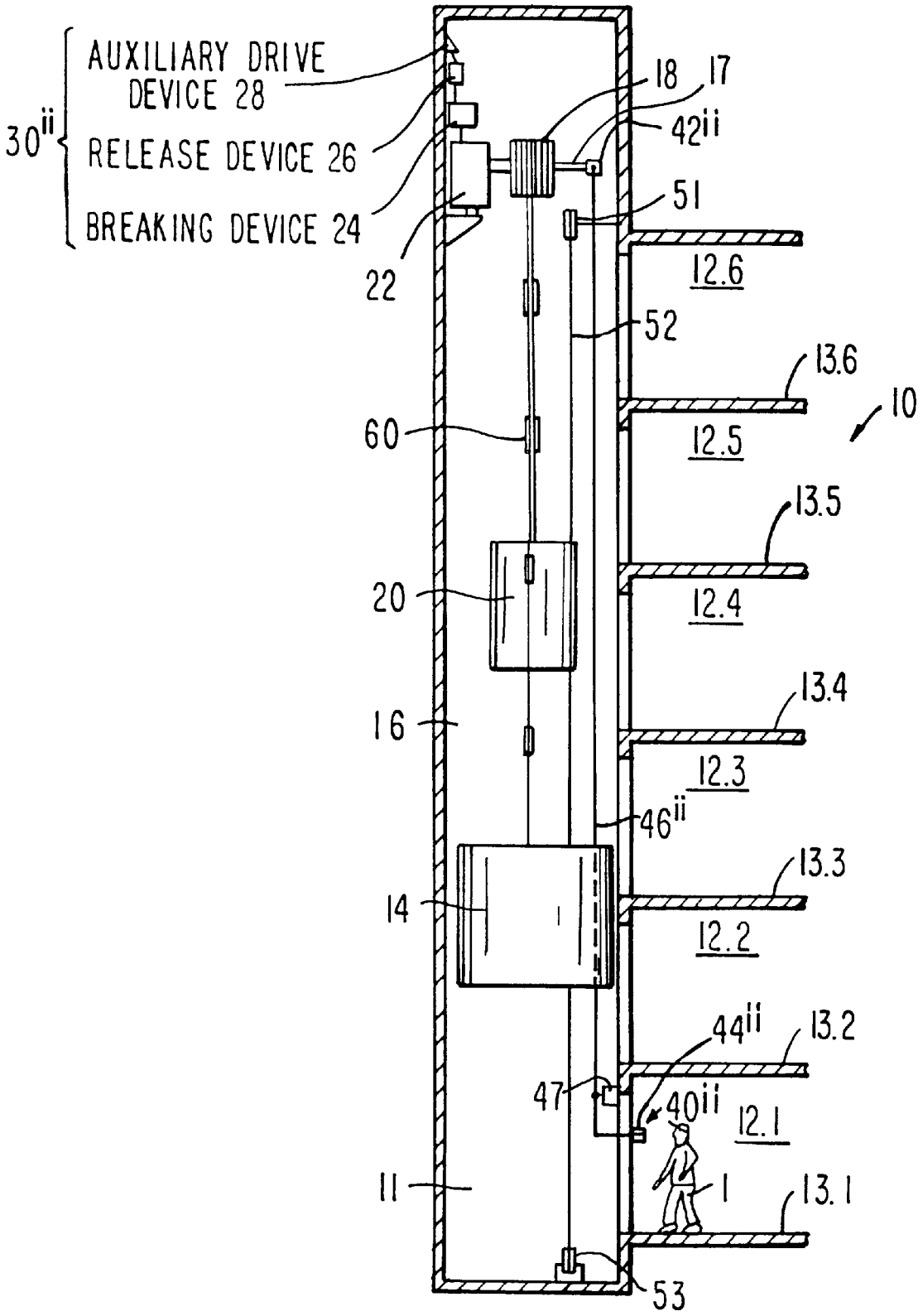
FIG. 3 shows a third auxiliary device according to the invention, with an image transmission device with a tachometer, in the same representation as FIG. 1A.
Figure 4A:
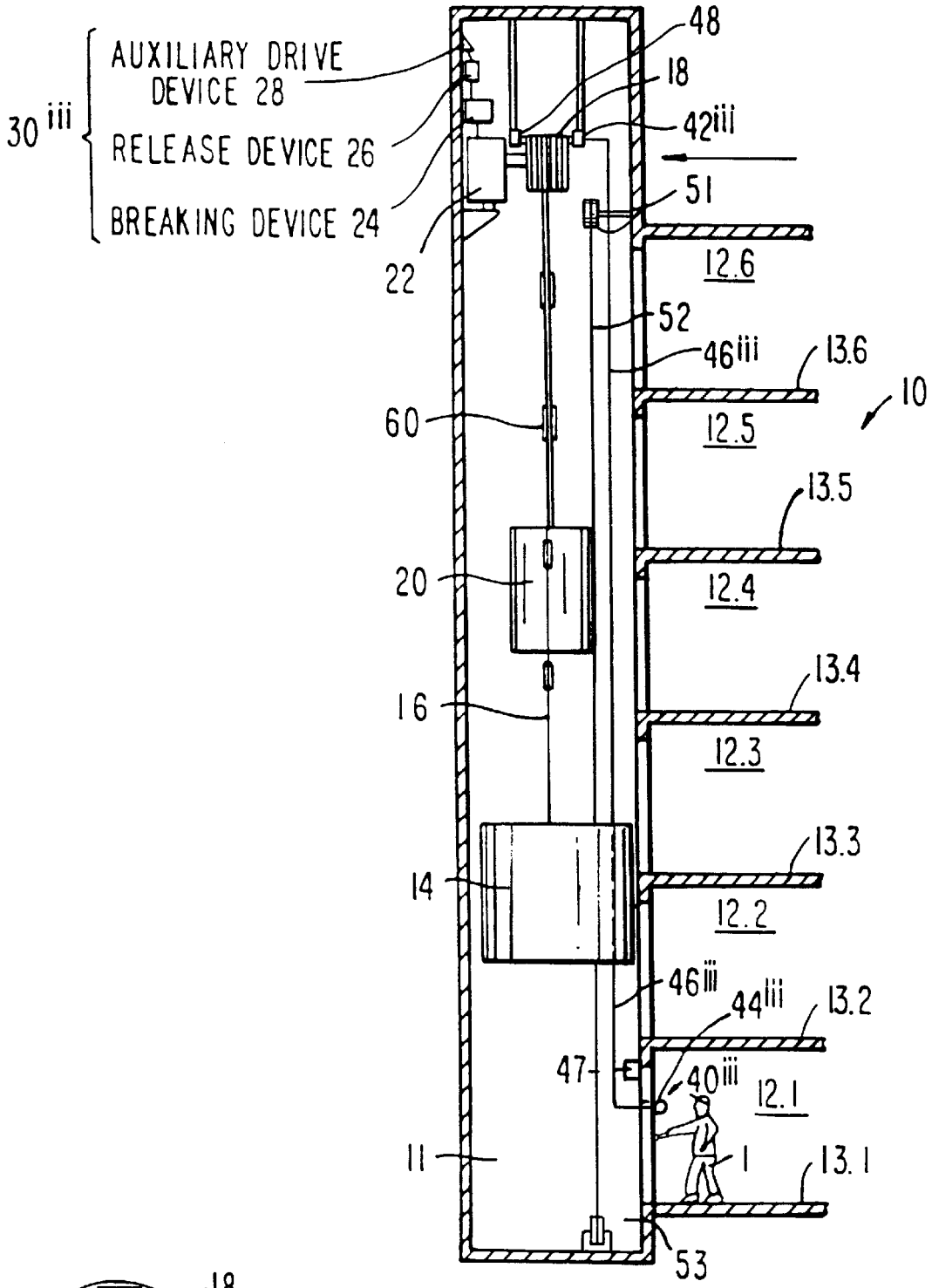
FIG. 4A shows a fourth auxiliary device according to the invention, with an image transmission device with a light barrier, in the same illustration as FIG. 1A.
Figure 4B:
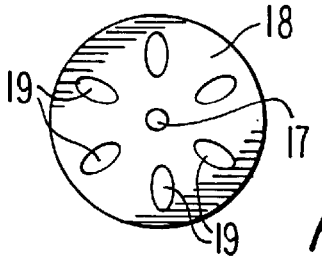
FIG. 4B shows the drive pulley illustrated in FIG. 4A, in enlarged representation, 4A, in a view in the direction of arrow IV of FIG. 4A.

In FIG. 3 there is illustrated a third auxiliary device $\mathbf{30}^{ii}$ for an elevator 10 with yet another image transmission device $\mathbf{40}^{ii}$. In that case, the sensor is formed by a tachometer unit $\mathbf{42}^{ii}$ arranged at the drive pulley 18. The display device is a conventional tacho display device $\mathbf{44}^{ii}$ viewable from a location in the lowermost station. The tachometer unit $\mathbf{42}^{ii}$ and the tacho display $\mathbf{44}^{ii}$ are connected together by an electric conductor connection $\mathbf{46}^{ii}$, which forms the transfer path. The tachometer unit $\mathbf{42}^{ii}$ can be arranged, instead of at the shaft 19, also at a rotary element rotating in fixed relationship with the drive pulley 18. A fourth auxiliary device $\mathbf{30}^{iii}$ for the elevator 10 is illustrated in FIGS. 4A and 4B. The image transmission device $\mathbf{40}^{iii}$ of this auxiliary device $\mathbf{30}^{iii}$ requires the drive pulley 18 to have light-permeable zones 19, which are arranged in mutual angular spacings at a constant radius. According to FIG. 4B the light-permeable zones 19 are formed by slot-shaped passages. A light-emitting first element 48 of a light barrier $\mathbf{42}^{iii}$, 48 is oriented towards a location through which, on a rotation of the drive pulley 18, the light-permeable zones 19 thereof run. The second element $\mathbf{42}^{iii}$ of the light barrier $\mathbf{42}^{iii}$, 48 is arranged on the other side of the drive pulley 18 and forms the sensor of the image transmission device $\mathbf{40}^{iii}$. This second element $\mathbf{42}^{iii}$ of the light barrier $\mathbf{42}^{iii}$, 48 is connected by way of an electric conductor connection $\mathbf{46}^{iii}$, which is used as transfer path, with the display device $\mathbf{44}^{iii}$. The display device $\mathbf{44}^{iii}$ is a monitoring light with a bright/dark display, which is viewable in the lowermost station 12.1. Instead of the drive pulley 18 there can also be provided another rotary element, which rotates in fixed relationship with the drive pulley, in the form of a rotary disc with light-permeable zones.

Figure 5:
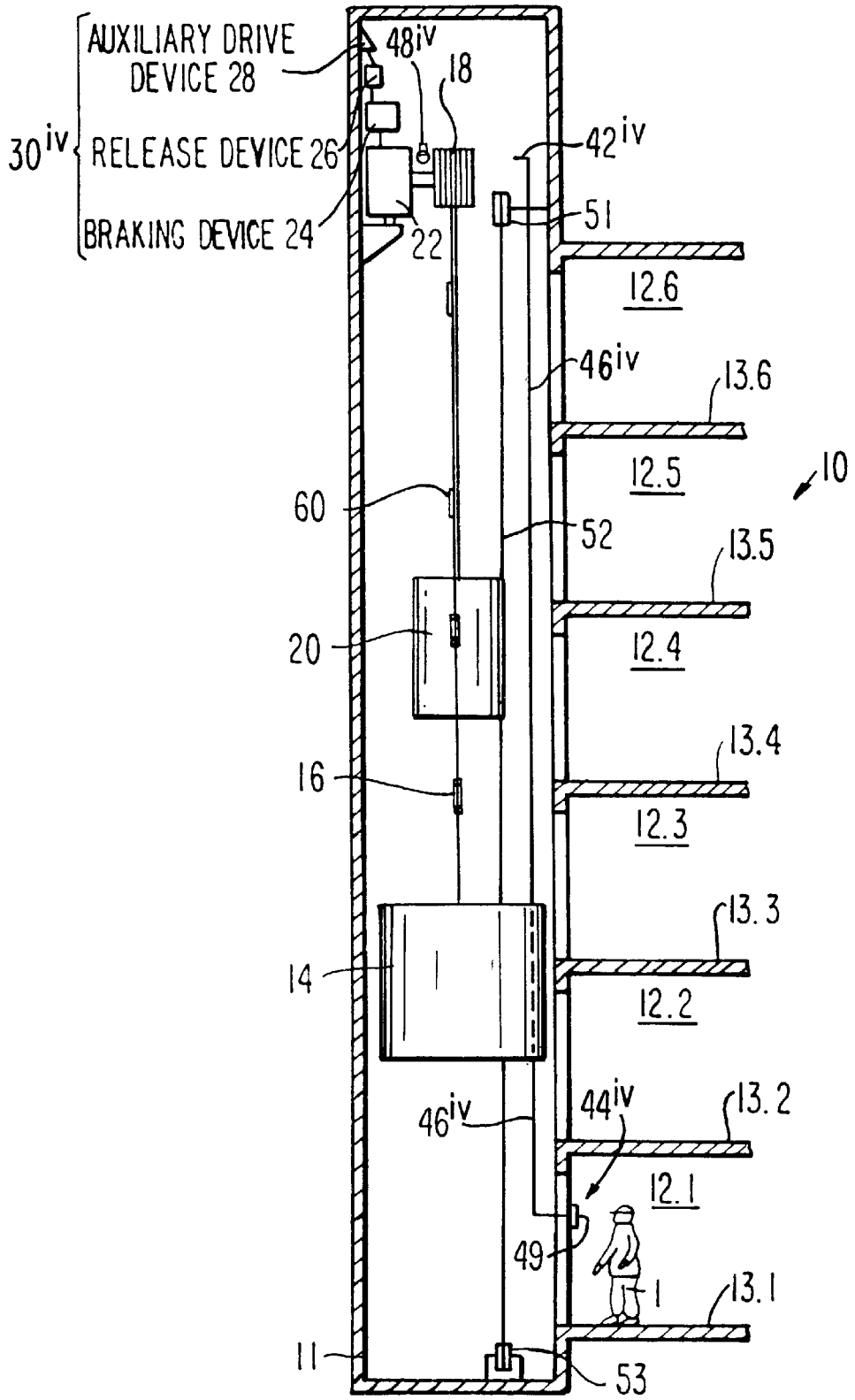
FIG. 5 shows a fifth auxiliary device according to the invention, with an image transmission device with a transfer path formed by an optical conductor arrangement.

FIG. 5 shows a fifth auxiliary device $\mathbf{30}^{iv}$ for the elevator 10, which is very similar to the auxiliary device described with respect to FIGS. 4A and 4B and which likewise has a drive pulley 18 or another rotary disc with light-permeable zones 18. Here, however, a conventional light source or lamp $\mathbf{48}^{iv}$ is provided as the light-emitting element and the sensor is formed by an input $\mathbf{42}^{iv}$ of an optical conductor arrangement $\mathbf{46}^{iv}$, which is used as the transfer path. The output of the optical conductor arrangement $\mathbf{46}^{iv}$, which can be considered as the display device $\mathbf{44}^{iv}$, is oriented towards a translucent surface 49 viewable from outside the elevator shaft 11. The effect of the display device $\mathbf{44}^{iv}$ is that of a monitoring lamp with a bright/dark display.

Figure 6:
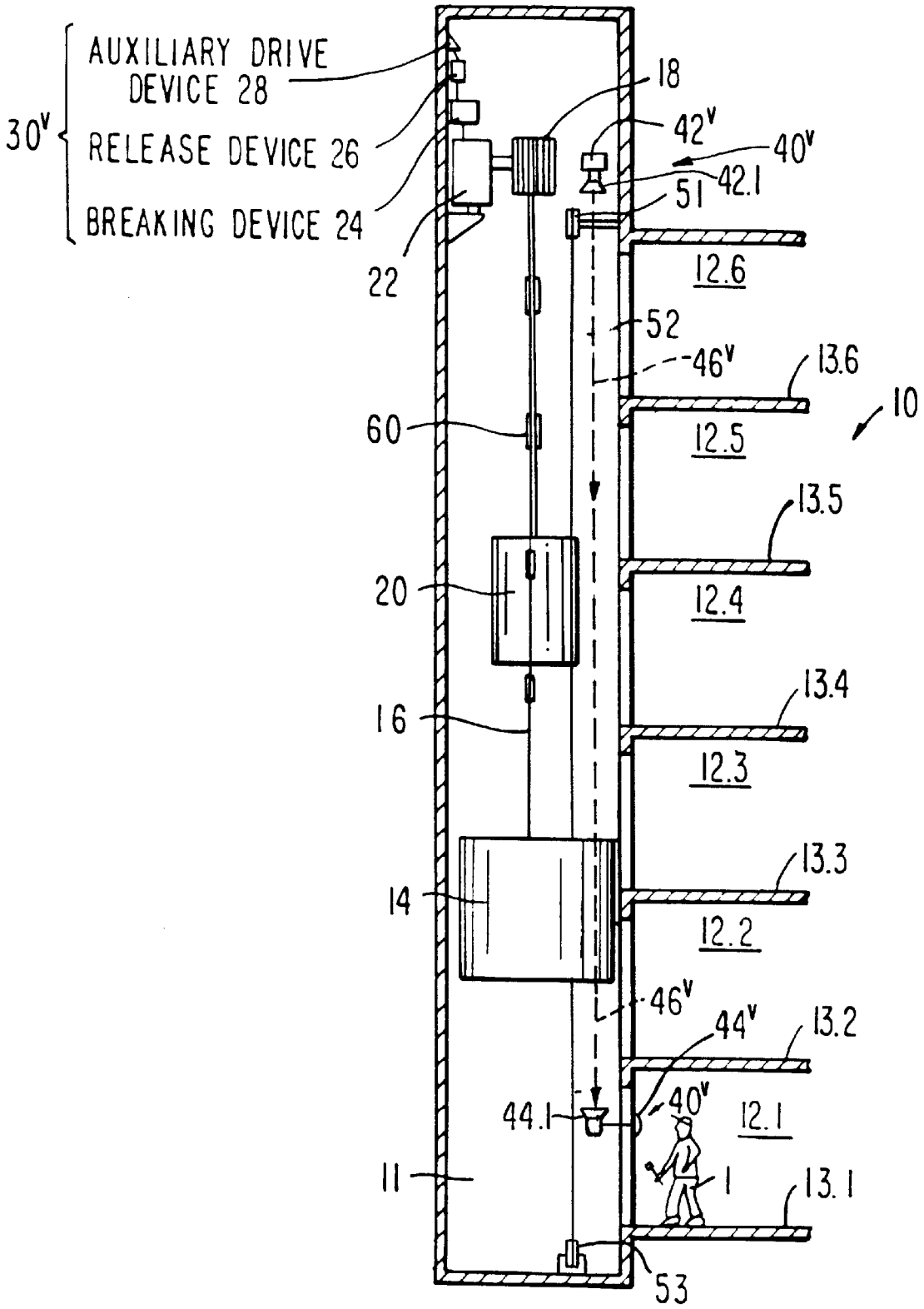
FIG. 6 shows a sixth auxiliary device according to the invention, with an image transfer device with a non-material transfer path.

Finally, in FIG. 6 there is illustrated a sixth auxiliary device $\mathbf{30}^{v}$ for the elevator 10, wherein the image transmission device $\mathbf{40}^{v}$ comprises an emitter 42.1 coupled with the sensor $\mathbf{42}^{v}$ and a receiver 44.1 coupled with the display device $\mathbf{44}^{v}$ as well as a non-material transfer path $\mathbf{46}^{v}$ in the form of a radio or laser beam connection.

The arrangements, which are shown in FIGS. 1 to 6, of the image transmission device 40 with the display device 44 represent merely one of the possible embodiments of the invention. The components of the image transmission device 40 together with the display device 44 are to be arranged in the elevator shaft 11 where, with respect to the storey, the technical and constructional requirements appear most appropriate.

In FIGS. 1 to 6 a sight-free visualization of the unit 51, 52, 53 for speed limitation by means of the image transmission device 40 is not, in fact, illustrated, but a corresponding arrangement of the image transmission device 40 for sight-free visualization of the unit 51, 52, 53 for speed limitation is possible. It is to be decided in accordance with the respective application how the image transmission device 40 is to be arranged. In principle, the above-mentioned embodiments also apply in the case of the sight-free visualization of the unit 51, 52, 53 for speed limitation.

Moreover, colored marks 60 or marks 60 of another kind can be applied to the support cable 16 or the limiter cable 52 in order to determine the position of the elevator cage 14.

The invention is suitable for elevators without an engine room. By that there are to be understood elevators which have no actual engine room. The drive thereof is thus disposed in the elevator shaft near the counterweight and the elevator cage.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. An auxiliary device for moving a payload receptacle of an elevator, comprising: an auxiliary drive device coupleable with a drive unit for the payload receptacle; means for limiting speed of the pay load receptacle; and an image transmission device arranged for sight-free visualization of one of a movable component of the drive unit and a movable component of the speed limiting means, the image transmission device comprising a sensor for detecting images representing movement of one of the drive unit and the speed limiting means, display device for visualization of the images detected by the sensor, and a transfer path connected between the sensor and the display device for transferring the images detected by the sensor to the display device.

2. An auxiliary device according to claim 1, wherein the sensor is a first mirror oriented towards one of the drive unit and the speed limiting means, and the display device is a second mirror, and the second mirror being oriented towards the first mirror so as to form the transfer path.

3. An auxiliary device according to claim 1, wherein the transfer path is a conductor connection.

4. An auxiliary device according to claim 1, wherein the sensor is a camera, the display device is a monitor, and the transfer path is an electric conductor connection.

5. An auxiliary device according to claim 1, wherein the sensor is operative to detect images of the movement of a rotating rotary element connected with the drive unit.

6. An auxiliary device according to claim 5, wherein the rotary element is a shaft of the drive unit, the sensor is a tachometer element arranged at the shaft, and the display device is a tacho display.

7. An auxiliary device according to claim 5, wherein the rotary element is a drive pulley of the drive unit, the pulley having light-permeable zones arranged at mutual angular spacings along a circle arranged concentrically with a rotational axis of the pulley, the image transmission device further including a light source arranged on one side of the rotary element, the sensor being arranged on an opposite side of the rotary element so as to sense light emitted by the light source.

8. An auxiliary device according to claim 7, wherein the light source and the sensor are elements of a light barrier and the transfer path is an electric conductor connection.

9. An auxiliary device according to claim 7, wherein the sensor is an input of an optical conductor arrangement, the conductor connection is the optical conductor arrangement and the display is an output of the optical conductor arrangement.

10. An auxiliary device according to claim 1, and further comprising an emitter and a receiver, the sensor being coupled with the emitter, the display device being coupled with the receiver and the transfer path being one of a radio connection and a laser light connection.

11. A device for monitoring position and movement of a cage in a shaft of an elevator, comprising: first means for monitoring the movement of the cage, which first means includes a unit for detection of the movement, a data transmission path and a display unit; and second means for monitoring the position of the cage, which second means includes means for reproducing the position of the cage.

12. A device according to claim 11, and further comprising a drive unit for movement of the cage, the unit for detection of the movement of the cage being operative to enable a conclusion about the movement of the cage to be made by way of a detection of the movement of a movable part of the drive unit.

13. A device according to claim 11, and further comprising speed-limiting means for limiting cage speed, the unit for detection of the movement of the cage being operative to enable a conclusion about the movement of the cage to be made by way of detection of movement of a movable part of the speed-limiting means.

14. A device according to claim 12, wherein the unit for detection of the movement of the cage comprises a flexible shaft connected with the movable part of the drive unit, the display unit including one of a rotating disc and a tachometer.

15. A device according to claim 13, wherein the unit for detection of the movement of the cage comprises a flexible shaft connected with the movable part of the speed-limiting unit, the display unit including one of a rotating disc and a tachometer.

16. A device according to claim 13, wherein the speed-limiting means includes a cable, the means for reproducing the position of the cage including marks at the cable of the speed-limiting means.

17. A device according to claim 11, and further comprising support means for supporting the cage, the means for reproducing the position of the cage including marks at the support means.

* * * * *